US011913208B2

(12) United States Patent
Eto et al.

(10) Patent No.: US 11,913,208 B2
(45) Date of Patent: Feb. 27, 2024

(54) FLUSH TOILET

(71) Applicant: TOTO LTD., Kitakyushu (JP)

(72) Inventors: Yusuke Eto, Kitakyushu (JP); Takahiro Maruyama, Kitakyushu (JP); Wataru Ishimi, Kitakyushu (JP); Taketo Okubo, Kitakyushu (JP); Seiya Nakashima, Kitakyushu (JP)

(73) Assignee: TOTO LTD., Kitakyushu (JP)

( * ) Notice: Subject to any disclaimer, the term of this patent is extended or adjusted under 35 U.S.C. 154(b) by 121 days.

(21) Appl. No.: 17/852,712

(22) Filed: Jun. 29, 2022

(65) Prior Publication Data

US 2023/0035354 A1 Feb. 2, 2023

(30) Foreign Application Priority Data

Jul. 30, 2021 (JP) ..... 2021-125866

(51) Int. Cl.

| | |
|---|---|
| ***E03D 11/13*** | (2006.01) |
| ***E03D 11/02*** | (2006.01) |
| ***E03D 11/08*** | (2006.01) |

(52) U.S. Cl.

CPC ..... *E03D 11/13* (2013.01); *E03D 11/025* (2013.01); *E03D 11/08* (2013.01); *E03D 2201/40* (2013.01)

(58) Field of Classification Search

CPC ..... E03D 11/13; E03D 11/025; E03D 11/08; E03D 2201/40; E03D 3/10; E03D 5/00

See application file for complete search history.

(56) References Cited

U.S. PATENT DOCUMENTS

2018/0049606 A1 2/2018 Rokuta et al.

FOREIGN PATENT DOCUMENTS

| | | | |
|---|---|---|---|
| JP | 2008-267026 A | | 11/2008 |
| JP | 2009191500 A | * | 8/2009 |
| JP | 2014-114632 A | | 6/2014 |
| JP | 2015-183429 A | | 10/2015 |
| JP | 2017-89282 A | | 5/2017 |
| JP | 2017-214743 A | | 12/2017 |
| JP | 2017214743 A | * | 12/2017 |
| JP | 2018-28200 A | | 2/2018 |

OTHER PUBLICATIONS

Notice of Reasons for Refusal issued in Japanese Patent Application No. 2023-095294, dated Aug. 9, 2023, with English translation.

* cited by examiner

*Primary Examiner* — Christine J Skubinna
(74) *Attorney, Agent, or Firm* — BakerHostetler

(57) ABSTRACT

A flush toilet includes a toilet main body made of ceramics, a control unit, a supply source that enables water supply or power supply to the control unit, and a flexible elongated member connecting the supply source and the control unit. The toilet main body includes a rear storage configured to store at least a part of the control unit. The rear storage includes an upper storage region, a lower region, and a lower communication region. The flexible elongated member extends from an upper connecting end portion toward a lower connecting end portion, to be inserted from the upper storage region into the lower communication region, and then extends from inside of the lower communication region to outside of the toilet main body, without extending through the lower region.

6 Claims, 8 Drawing Sheets

FLUSH TOILET

CROSS REFERENCE TO RELATED APPLICATION

This application claims benefit of priority to Japanese Patent Application No. 2021-125866, filed on Jul. 30, 2021, the entire content of which is incorporated herein by reference.

BACKGROUND OF THE INVENTION

Field of the Invention

The present invention relates to a flush toilet, and more particularly, to a flush toilet which is flushed with flush water to discharge waste.

Description of the Related Art

Conventionally, as a flush toilet which is flushed with flush water to discharge waste, there is known, for example, as described in Patent Document 1 (Japanese Patent Laid-Open No. 2008-267026), Patent Document 2 (Japanese Patent Laid-Open No. 2014-114632) and Patent Document 3 (Japanese Patent Laid-Open No. 2017-89282), a so-called "full skirt" or "total Hakama" flush toilet in which a skirt formed on an outer side than a side surface of each of a bowl of a toilet main body made of ceramics and a water discharge trap is formed all around the toilet main body. In such a conventional "full skirt" or "total Hakama" flush toilet, a control unit including a function of controlling discharging and stopping of flush water to a bowl of a toilet main body is provided, and this control unit is stored in a storage region more rearward than the bowl of the toilet main body.

Next, in a conventional flush toilet in Patent Document 1 described above, a water supply hose has one end connected to a control unit in a region behind a toilet main body, and is inserted downward through an opening in a rear wall of the toilet main body, and the water supply hose has the other end connected to a stop cock provided on a floor. Also, in another conventional flush toilet in Patent Document 2 described above, a through hole is provided penetrating, in an up-down direction, a supporting wall that divides, in the up-down direction, a region more rearward than a bowl of a toilet main body. Parts stored in an upper region and a lower region, respectively, are divided in the up-down direction by the supporting wall, and coupled via the through hole.

Further, in still another conventional flush toilet in Patent Document 3 described above, a sheath tube is provided functioning as a water supply hose configured to supply flush water, a wiring hose into which a power supplying wire is inserted, or the like. This sheath tube has one end portion connected to a control unit in a region behind a toilet main body, and the sheath tube is inserted into a space in a double wall provided in a side wall of the toilet main body, and then extends outward from the toilet main body through a lower space of the toilet main body in which an exit of a water discharge trap is disposed. Furthermore, when the sheath tube functions as the water supply hose, the sheath tube has the other end portion connected to an external stop cock through the lower space of the toilet main body, and when the sheath tube functions as the wiring hose, the sheath tube has the other end portion connected to an external power source or the like through the lower space of the toilet main body.

On the other hand, an aim that has been requested to be achieved in recent years with design diversification of the flush toilet and improvement in design such as appearance of the flush toilet is to effectively use a storage region that stores a control unit in a region more rearward than a bowl of a toilet main body, while reducing (slimming) an external dimension of the whole toilet main body. Also, for example, in the conventional flush toilet, a flexible elongated member is adopted as the water supply hose or the wiring hose connected to the control unit, and this flexible elongated member uses a comparatively hard material with high elasticity in terms of durability or the like. Therefore, to install the flexible elongated member in a small storage region of the control unit of the toilet main body, when the flexible elongated member is sharply deformed by bending or the like, there are problems that kink is likely to occur and that it is difficult to handle the flexible elongated member in the storage region of the control unit.

Moreover, in the conventional flush toilet, the control unit is disposed relatively upward in the storage region on the rear side of the toilet main body, and hence an aim is to store the control unit within the storage region of the toilet main body as much as possible for preventing unexpected intrusion of waste or the like into the control unit and for making the control unit difficult to see from appearance of the toilet main body also in terms of designability such as appearance of the flush toilet. Furthermore, the water supply hose or the wiring hose connected to the control unit includes a connecting portion to the control unit, the connecting portion being disposed relatively upward in the storage region of the toilet main body. On the other hand, the water supply hose on an upstream side or the wiring hose on a power source side is connected to a water or power supply source (the stop cock, the power source or the like) provided, for example, below and outside the toilet main body. Consequently, from the viewpoint of not degrading designability such as appearance of the flush toilet, another aim is to hide a path in the middle of the water supply hose or the wiring hose in a limited storage region of the toilet main body. Additionally, still another aim is to extend the water supply hose or the wiring hose on a supply source side through an insertion hole or the like below the toilet main body toward an external supply source, and a further aim is to reduce a size of the insertion hole below the toilet main body for making the internal control unit invisible. In addition, from the viewpoint of fire prevention for the control unit and elongated member, for example, when considering a fire or the like from a back side of a rear wall of the toilet main body or from under the floor below the toilet main body, an aim is to separate the storage region that stores the control unit from a region below this storage region (in particular, a region in which an exit of a water discharge trap is disposed and which is easily combustible, for example, from a drain pipe extending from the wall back side or from under the floor, or the like).

Accordingly, the present invention is aimed at solving problems of the conventional arts described above and is aimed at providing a flush toilet which can improve handleability and fire prevention of a flexible elongated member connecting a supply source and a control unit for enabling water supply or power supply and which can improve designability of the whole flush toilet.

SUMMARY OF THE INVENTION

To solve the problems described above, an aspect of the present invention is a flush toilet comprising: a toilet main body made of ceramics, the toilet main body including a bowl configured to receive waste, a water discharge trap including an inlet connected to a lower portion of the bowl and an exit configured to discharge waste in the bowl, and a skirt formed on each outer side of the bowl and the water discharge trap, a control unit provided more rearward than the bowl of the toilet main body, the control unit including at least a function of controlling discharge and stopping of flush water to the bowl, a supply source provided below the control unit and outside the toilet main body, the supply source enabling water supply and/or power supply to the control unit, and a flexible elongated member configured to connect the supply source and the control unit, and wherein the toilet main body made of ceramics further includes a rear storage configured to store at least a part of the control unit, and the rear storage includes a supporting wall configured to support the control unit and configured to divide a region more rearward than the bowl of the toilet main body into upper and lower regions, and the supporting wall provides an upper storage region formed in the region above the supporting wall and configured to store at least a part of the control unit, a lower region formed in the region below the supporting wall and separated from the upper storage region, the lower region including the exit of the water discharge trap, and a lower communication region formed adjacent to and separated from the lower region, the lower communication region being configured to communicate between the upper storage region and outside of the toilet main body without communicating with the lower region, and wherein the flexible elongated member includes an upper connecting end portion connected to the control unit, and a lower connecting end portion connected to the supply source, and the flexible elongated member extends from the upper connecting end portion toward the lower connecting end portion and is inserted from the upper storage region into the lower communication region, and then the flexible elongated member extends from inside of the lower communication region to the outside of the toilet main body without extending through the lower region, and then the lower connecting end portion is connected to the supply source. In the present invention having this configuration, the flexible elongated member extends toward the lower connecting end portion from the upper connecting end portion connected to the control unit of the upper storage region in the rear storage, and the flexible elongated member can be inserted from the upper storage region of the rear storage into the lower communication region without extending through the lower region and without being bent or sharply angled. Thereafter, the elongated member inserted into the lower communication region can smoothly extend from the lower communication region to the outside of the toilet main body, not through the lower region of the rear storage, and the lower connecting end portion of the elongated member can be connected to the supply source. Accordingly, for the flexible elongated member connecting the control unit and the supply source, most of a middle portion of a path of the member can be hidden in the upper storage region or the lower communication region in the rear storage, so that designability such as appearance of the flush toilet can improve. Furthermore, the flexible elongated member is inserted from the upper storage region into the lower communication region, without extending through the lower region, so that handleability of the elongated member in a limited space of the rear storage of the toilet main body can be improved while suppressing deformation load of the middle path of the elongated member between the control unit and the supply source. Therefore, for example, permanent deformation or damage due to kink or the like can be inhibited from occurring in the flexible elongated member. Additionally, the improvement in handleability of the flexible elongated member can reduce a size of the rear storage of the toilet main body, and hence the whole flush toilet can be reduced in size and improved in designability. In addition, from the viewpoint of fire prevention, for example, if a fire occurs on a back side of a rear wall of the toilet main body or a peripheral part under a floor below the toilet main body and even if the fire spreads from the wall back side or from under the floor to a combustible space in the lower region of the rear storage of the toilet main body, a downstream side of the exit of the water discharge trap, or the like, each of the upper storage region and the lower communication region is separated from the lower region. Accordingly, risk of the fire in the lower region spreading to the control unit in the upper storage region and the elongated member in the lower communication region can be suppressed, and fire prevention for the control unit and the elongated member can be achieved.

In the present invention, preferably, the skirt includes a rear wall and a side wall which respectively form a back surface and a side surface of the skirt, at least a part of the side wall or the rear wall of the skirt forms a double wall, and the double wall includes an outer wall and an inner wall, the outer wall being forming an outer surface of the skirt and an inner wall being provided inside the outer wall, at least a part of the double wall being forming a double wall chamber in the lower communication region of the rear storage between the outer wall and the inner wall, the inner wall of the double wall forming the double wall chamber includes an inner communication hole formed to penetrate so as to communicate between the upper storage region and the double wall chamber, and the outer wall of the double wall forming the double wall chamber includes an outer communication hole formed to penetrate so as to communicate between the double wall chamber and the outside of the toilet main body, and the flexible elongated member extends from the upper connecting end portion of the upper storage region toward the lower connecting end portion and is inserted from the upper storage region into the double wall chamber through the inner communication hole in the double wall, and then the flexible elongated member extends from inside of the double wall chamber to the outside of the toilet main body through the outer communication hole of the double wall without extending through the lower region, and then the lower connecting end portion is connected to the supply source. In the present invention having this configuration, the flexible elongated member extends toward the lower connecting end portion from the upper connecting end portion connected to the control unit in the upper storage region of the rear storage, and the flexible elongated member can be inserted into the double wall chamber through the inner communication hole of the double wall without being bent or sharply angled from the upper storage region of the rear storage. Thereafter, the elongated member can smoothly extend from the inside of the double wall chamber to the outside of the toilet main body through the outer communication hole of the double wall, without extending through the lower region of the rear storage, and the lower connecting end portion of the elongated member can be connected to the supply source. Accordingly, for the flexible elongated member connecting the control unit and the supply source, most of the middle portion of the path of the member can be hidden in the upper storage region or the double wall chamber in the rear storage, so that the designability such as appearance of the flush toilet can improve. Furthermore, the flexible elongated member is inserted from the upper storage region into the double wall chamber, without extending through the lower region (double wall chamber), so that the handleability of the elongated member in the limited space of the rear storage of the toilet main body can be improved while suppressing the deformation load of the middle path of the elongated member between the control unit and the supply source. Therefore, for example, the permanent deformation or damage due to the kink or the like can be inhibited from occurring in the flexible elongated member. Additionally, from the viewpoint of the fire prevention, for example, if a fire occurs on the back side of the rear wall of the toilet main body or the peripheral part under the floor below the toilet main body and even if the fire spreads from the wall back side or from under the floor to the combustible space in the lower region of the rear storage of the toilet main body, the downstream side of the exit of the water discharge trap, or the like, each of the upper storage region and the lower communication region (double wall chamber) is separated from the lower region. Accordingly, the risk of the fire in the lower region spreading to the control unit in the upper storage region and the elongated member in the double wall chamber can be suppressed, and the fire prevention for the control unit in the upper storage region and the elongated member in the double wall chamber can be achieved. Furthermore, even if a foreign object from the outside of the toilet main body enters the lower communication region (double wall chamber) through the outer communication hole, the lower communication region (double wall chamber) and the upper storage region are divided in a portion other than the inner communication hole, and the foreign object from the outside of the toilet main body can be inhibited from reaching the control unit of the upper storage region through the outer communication hole.

In the present invention, preferably, the inner wall in the double wall forming the double wall chamber includes a horizontal wall forming a substantially horizontal wall surface, the inner communication hole is formed to penetrate the substantially horizontal wall surface of the horizontal wall, the outer wall in the double wall forming the double wall chamber includes a vertical wall forming a vertical wall surface extending in an up-down direction, and the outer communication hole is formed to penetrate the vertical wall surface of the vertical wall. In the present invention having this configuration, the inner communication hole penetrating the inner wall to communicate between the upper storage region and the double wall chamber can be formed penetrating the substantially horizontal wall surface of the horizontal wall of the inner wall in the double wall, and the outer communication hole penetrating the outer wall to communicate between the double wall chamber and the outside of the toilet main body can be formed penetrating the vertical wall surface of the vertical wall of the outer wall in the double wall. Accordingly, when the elongated member is inserted from the upper storage region into the inner communication hole and extended from the double wall chamber through the outer communication hole to the outside of the toilet main body, the elongated member does not have to be bent excessively, and can be smoothly inserted. Therefore, for example, the permanent deformation or damage due to the kink or the like can be effectively inhibited from occurring in the flexible elongated member.

In the present invention, preferably, the inner communication hole has a center axis positioned more rearward than a center of the horizontal wall in a front-rear direction, and the outer communication hole is formed in the outer wall of the double wall in the rear wall of the skirt. In the present invention having the configuration, the center axis of the inner communication hole is positioned more rearward than the center of the horizontal wall in the front-rear direction, and the outer communication hole is formed in the outer wall of the double wall in the rear wall of the skirt. Therefore, the inner communication hole of the horizontal wall can be disposed on a rear wall side of the skirt, compared to when the center axis of the inner communication hole is positioned at the same position as or in front of the center of the horizontal wall in the front-rear direction. Consequently, a distance between the inner communication hole and the outer communication hole can be reduced, and hence when the elongated member is inserted into the inner communication hole and the outer communication hole, the member can be easily guided into the respective communication holes. Thereby, it is not necessary to bend or sharply angle the flexible elongated member. Also, since the center axis of the inner communication hole is positioned more rearward than the center of the horizontal wall in the front-rear direction, it is not necessary to excessively bend and deform the flexible elongated member so that the member does not interfere with a front part or the like of the control unit, when performing, for example, a work of connecting the upper connecting end portion of the elongated member to the control unit in a state where the elongated member is inserted into the inner communication hole and the outer communication hole. As a result, the permanent deformation or damage due to the kink or the like can be more effectively inhibited from occurring in the flexible elongated member. Furthermore, by reducing the distance between the inner communication hole and the outer communication hole, it is possible to suppress a thickness of the double wall forming the double wall chamber between the inner communication hole and the outer communication hole into which the elongated member is inserted, so that the whole toilet main body can be reduced in size.

In the present invention, preferably, the double wall chamber is formed below the upper storage region, and the elongated member is inserted from inside of the upper storage region through the inner communication hole into the double wall chamber. In the present invention having this configuration, the elongated member can be smoothly handled by inserting the member into the double wall chamber formed below the upper storage region. Furthermore, it is possible to suppress a thickness of the side wall of the skirt and a width of the whole toilet main body in a left-right horizontal direction, compared to when the elongated member is inserted into the double wall chamber formed on a lateral side of the upper storage region. Therefore, the whole flush toilet can be reduced in size.

In the present invention, preferably, the elongated member includes the upper connecting end portion connected to a front or side portion of the control unit, and the elongated member once extends diagonally forward and downward or laterally and diagonally downward, is then directed diagonally rearward and downward to the inner communication hole, inserted into the outer communication hole through the inner communication hole via the double wall chamber, without extending through the lower region, and guided to the outside of the toilet main body. In the present invention having this configuration, the elongated member includes the upper connecting end portion connected to a front or side portion of the control unit, and the elongated member once extends diagonally forward and downward or laterally and diagonally downward, then the elongated member is directed diagonally rearward and downward to the inner communication hole, and after that the elongated member is inserted into the outer communication hole through the inner communication hole via the double wall chamber without extending through the lower region, and then the elongated member is guided to the outside of the toilet main body. Furthermore, the flexible elongated member is inserted into the double wall chamber from the upper storage region, without extending through the lower region, so that the handleability of the elongated member in the limited space of the rear storage of the toilet main body can be further improved while suppressing the deformation load of the middle path of the elongated member between the control unit and the supply source. Therefore, for example, the permanent deformation or damage due to the kink or the like can be effectively inhibited from occurring in the flexible elongated member.

The flush toilet of the present invention can improve handleability and fire prevention of the flexible elongated member connecting the supply source and the control unit for enabling water supply or power supply, and can improve designability of the whole flush toilet.

and

Figure 7:
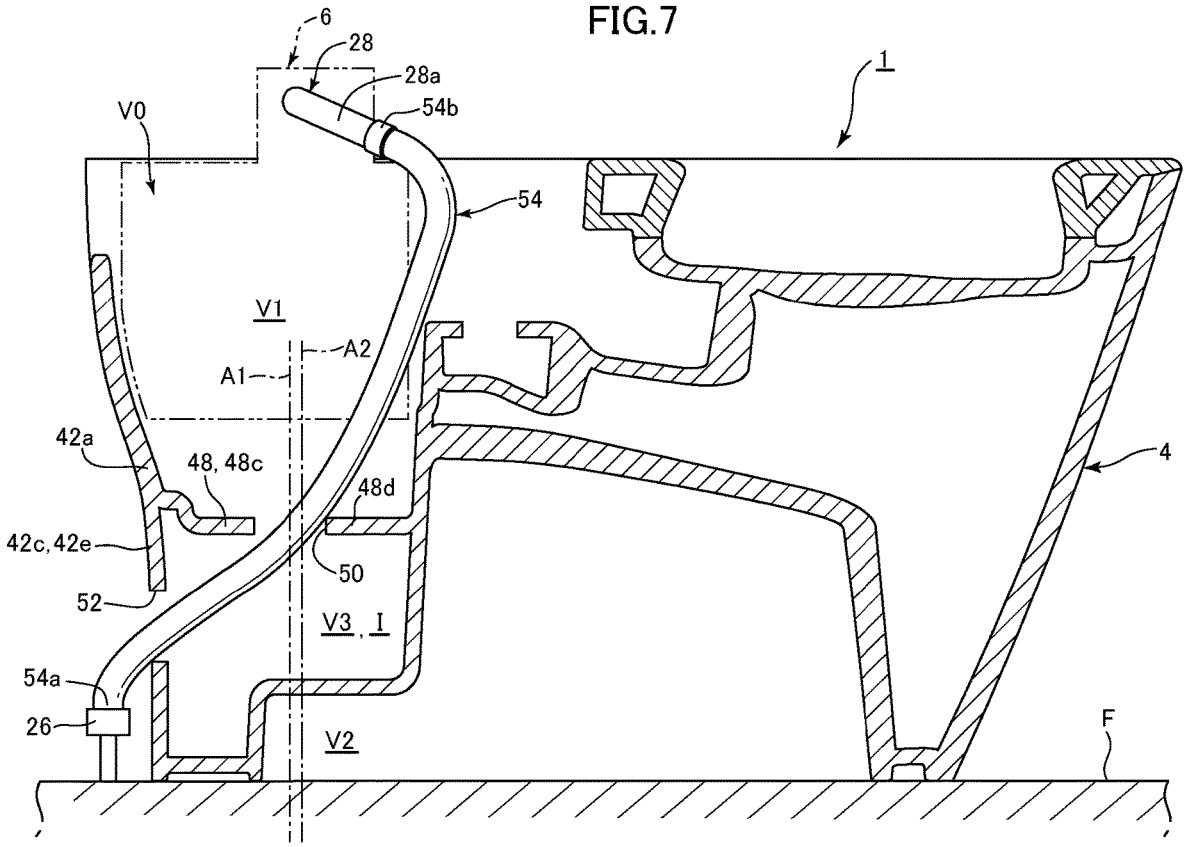
FIG. 7 is a cross-sectional view taken along a line VII-VII of FIG. 3.
Figure 8:
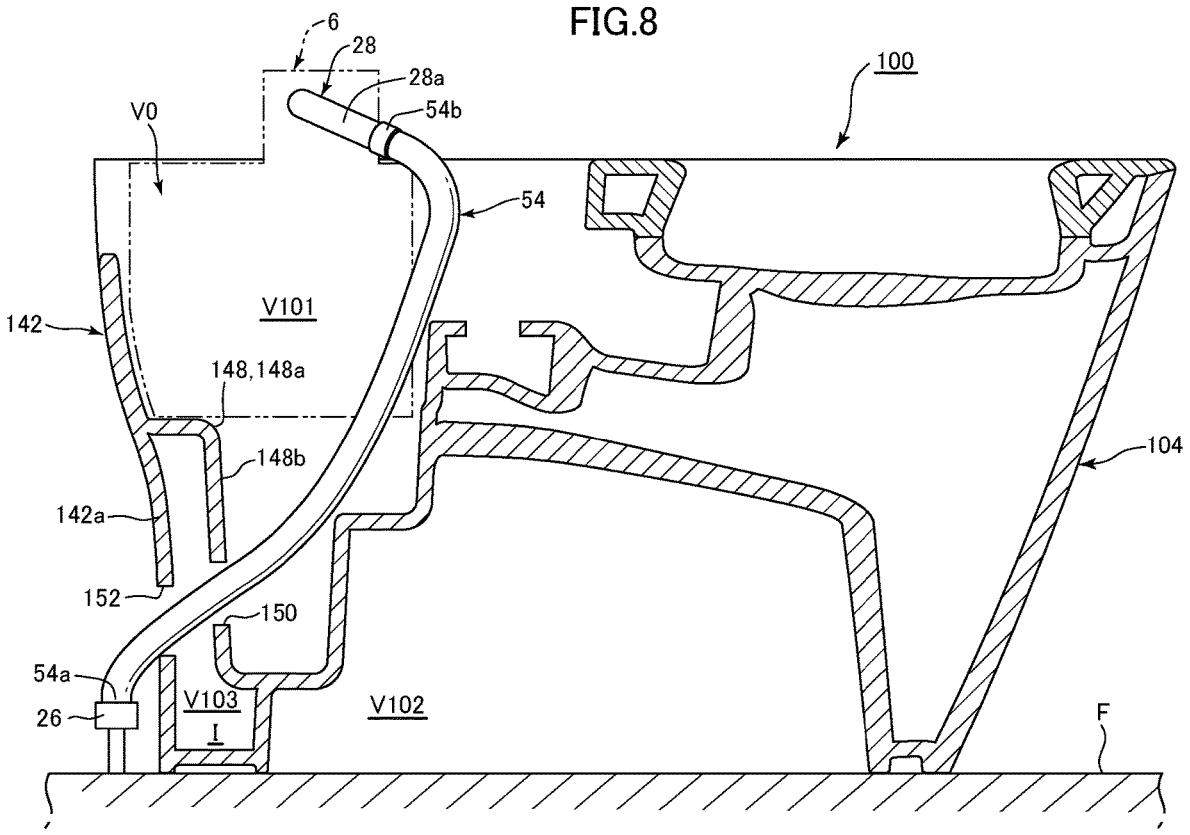

FIG. 8 is a cross-sectional view, similar to FIG. 7, of a flush toilet according to a second embodiment of the present invention.

DETAILED DESCRIPTION OF THE PREFERRED EMBODIMENTS

Figure 1:
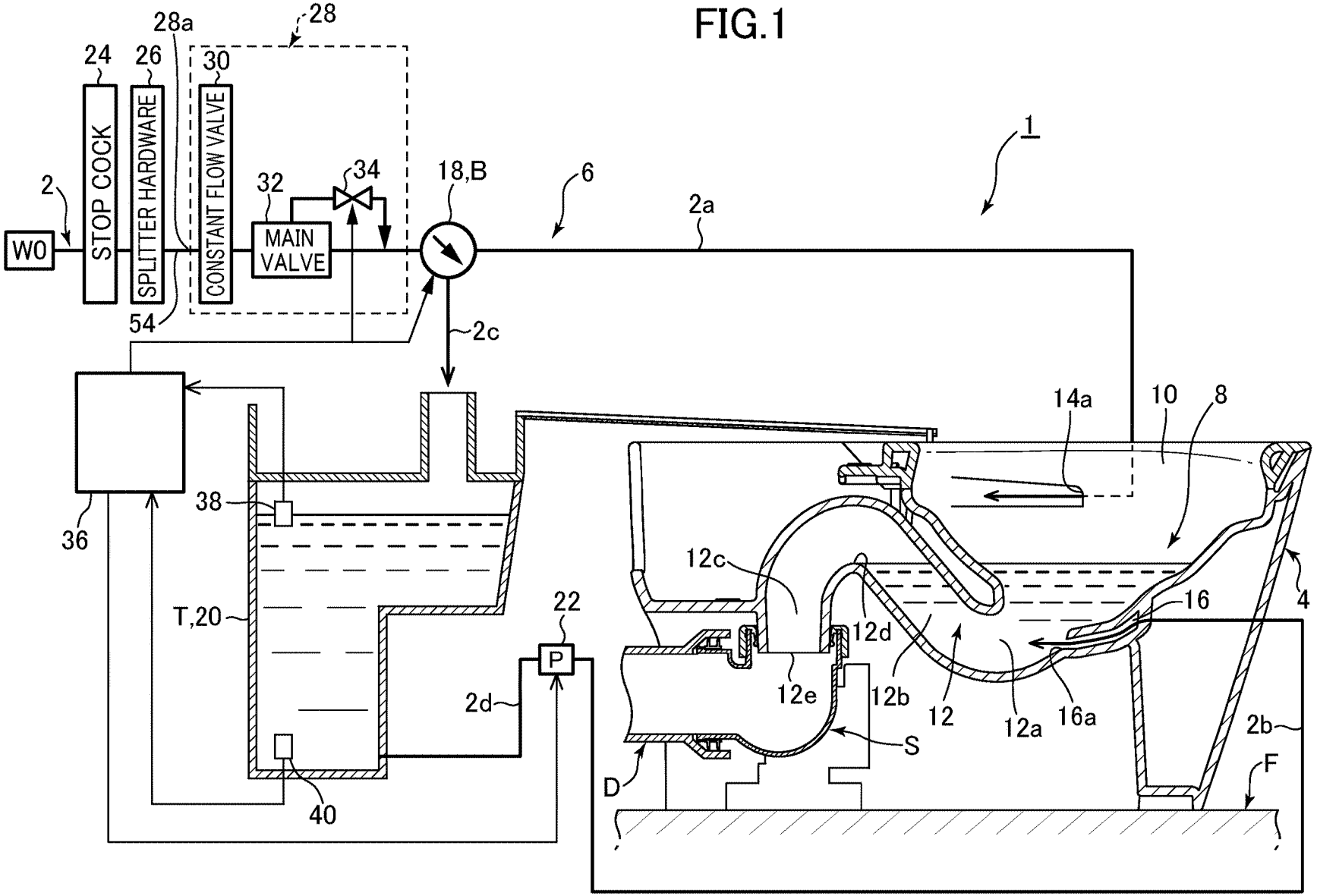
FIG. 1 is an overall structural diagram of a flush toilet according to a first embodiment of the present invention.
Figure 2:
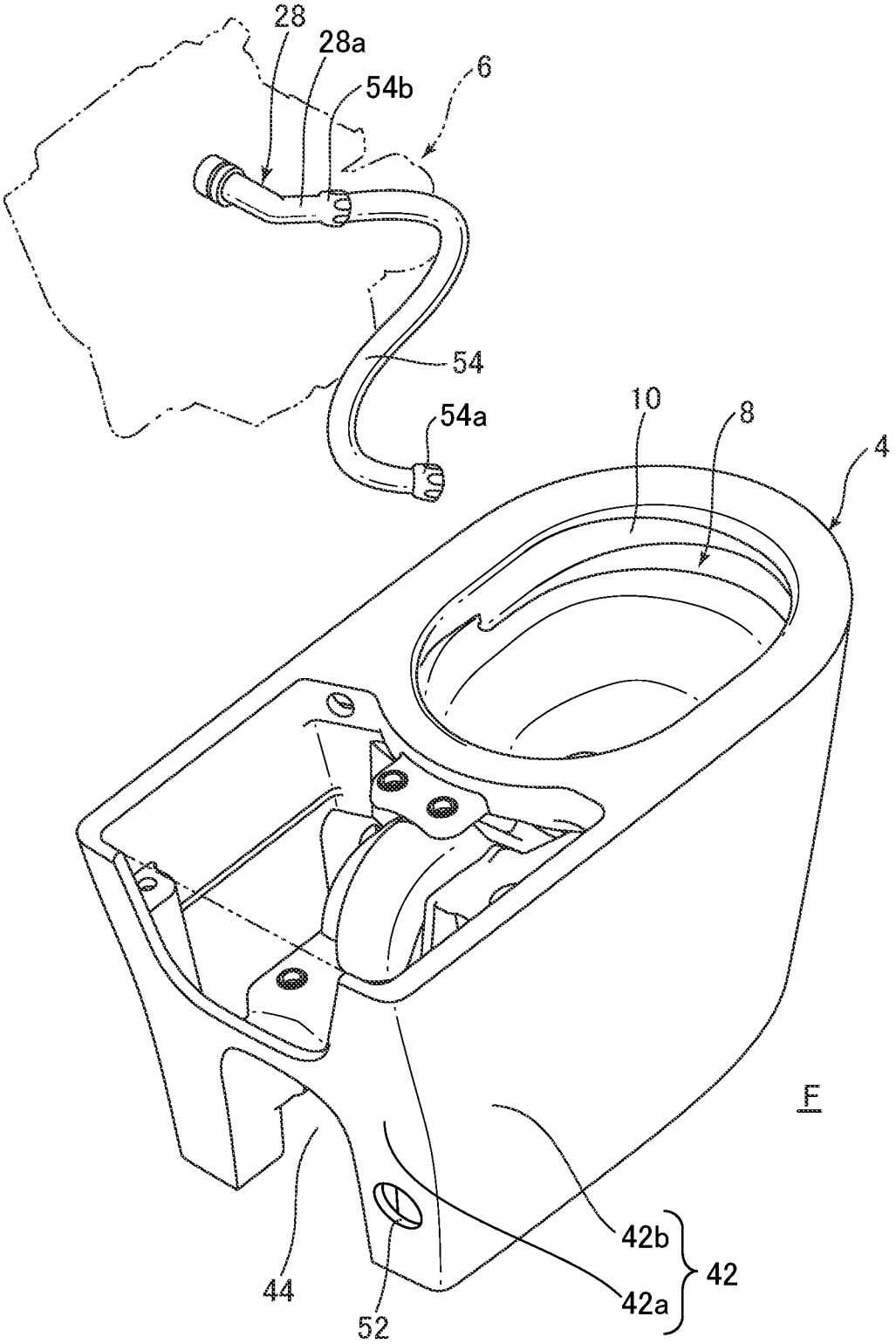
FIG. 2 is an exploded perspective view of the flush toilet according to the first embodiment of the present invention seen from rear and diagonally above.
Figure 3:
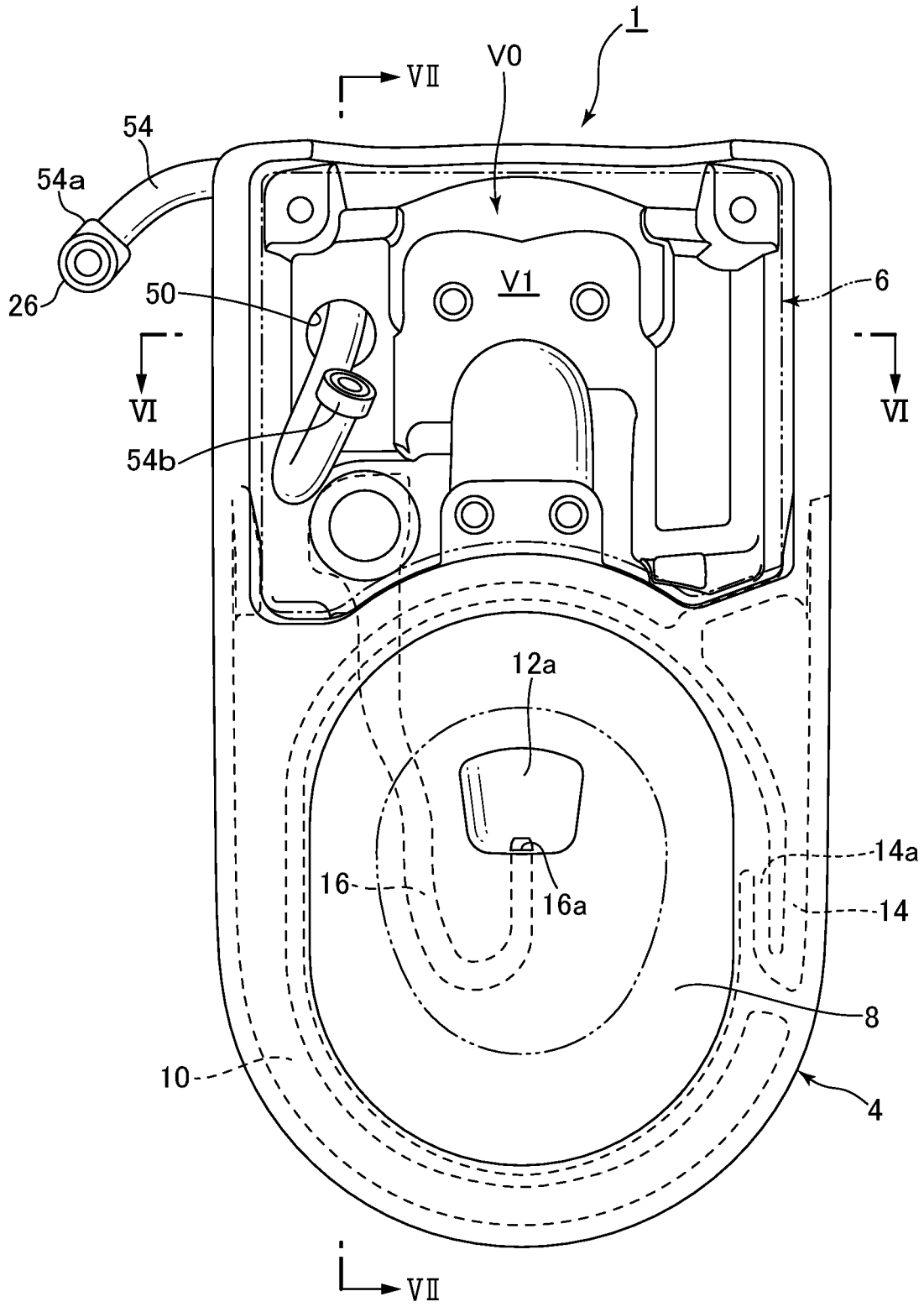
FIG. 3 is a plan view of the flush toilet according to the first embodiment of the present invention.

Hereinafter, a flush toilet according to a first embodiment of the present invention will be described with reference to the accompanying drawings. First, an entire configuration of the flush toilet according to the first embodiment of the present invention will be schematically described with reference to FIGS. 1 to 3. As shown in FIGS. 1 to 3, a flush toilet 1 according to the first embodiment of the present invention includes a water supply channel (a main water passageway 2) where flush water that is supplied from a main water supply source WO such as a water system flows through, a toilet main body 4 made of ceramics, and a flush water supply device 6.

Next, as shown in FIGS. 1 to 3, the toilet main body 4 includes a bowl 8 for receiving waste, a rim 10 that is formed at a top edge of the bowl 8, and a water discharge trap 12 extending from a bottom portion of the bowl 8. Furthermore, as shown in FIGS. 1 to 3, although details will be given later, the flush water supply device 6 is a control unit that is provided more rearward than the bowl 8 of the toilet main body 4 and that enables flush water supplied from the main water passageway 2 to be supplied to the toilet main body 4. More specifically, this control unit includes a function of controlling discharge and stopping of flush water to the bowl 8 of the toilet main body 4 by operating on power.

Next, as shown in FIG. 3, a rim conduit 14 is formed in the rim 10 on one of left and right sides of the toilet main body 4 (right side of the toilet main body 4 seen from front in FIG. 3). The rim conduit 14 has a so-called U-turn shape that extends forward from the rear side of the toilet main body 4 and then bends rearward, in the rim 10 on one of the left and right sides of the toilet main body 4 (right side of the toilet main body 4 seen from front in FIG. 3). Further, a rim spout port 14*a* is provided on a downstream end (downstream rear end) of the rim conduit 14. Furthermore, a rim-side water supply channel 2*a* of the flush water supply device 6 is connected on an upstream side of the rim conduit 14 of the toilet main body 4. Flush water that is supplied from the rim-side water supply channel 2*a* to the rim spout port 14*a* is discharged into the bowl 8, rearward from the rim spout port 14*a*, and rim spouting is thus performed.

Next, as shown in FIGS. 1 and 3, a jet conduit 16 is formed extending from an outer surface of the bowl 8 of the toilet main body 4 to the bottom portion. A downstream side of the jet conduit 16 faces an inlet 12*a* of the water discharge trap 12 at the bottom portion of the bowl 8, and a jet spout port 16*a* is provided on a downstream end of the jet conduit 16. Furthermore, a jet-side water supply channel 2*b* of the flush water supply device 6, of which more later, is provided on an upstream side of the jet conduit 16 of the toilet main body 4. Flush water that is supplied from the jet-side water supply channel 2*b* to the jet conduit 16 of the toilet main body 4 is discharged from the jet spout port 16*a* toward the inlet 12*a* of the water discharge trap 12, and jet spouting is thus performed. Now, as shown in FIG. 1, an upstream side of the rim-side water supply channel 2*a* of the flush water supply device 6 is connected to a switching valve 18 at a branch part B on the main water passageway 2. For its part, an upstream side of the jet-side water supply channel 2*b* of the flush water supply device 6 is connected to a pressure pump 22 of the flush water supply device 6 provided on a downstream side of a storage tank 20 of the flush water supply device 6, as shown in FIG. 1.

Next, the water discharge trap 12 of the toilet main body 4 includes the inlet 12*a* provided at the bottom portion of the bowl 8, an ascending pipe 12*b* that ascends from the inlet 12*a*, and a descending pipe 12*c* that descends from the ascending pipe 12*b*, and a part between the ascending pipe 12*b* and the descending pipe 12*c* is a top portion 12*d*. Also, as shown in FIG. 1, an exit 12*e* of the descending pipe 12*c* of the water discharge trap 12 is connected to an inlet of a discharge socket S that is disposed behind and below the toilet main body 4. Furthermore, as shown in FIG. 1, an exit of the discharge socket S on the rear side is connected to an inlet of a drainpipe D extending from a wall (not shown) on the rear side of the toilet main body 4. Consequently, a so-called water discharge mode of "wall side water discharge" is formed where water discharged through the exit 12*e* of the water discharge trap 12 of the toilet main body 4 is discharged from the discharge socket S to the drainpipe D on a wall side. Additionally, the flush toilet 1 of the present embodiment is not limited to this water discharge mode of "wall side water discharge", and is applicable to a so-called water discharge mode of "floor side water discharge" where water discharged through the exit 12*e* of the water discharge trap 12 of the toilet main body 4 is discharged from the discharge socket S to a drainpipe provided below an installation surface (floor F) of a bottom surface of the toilet main body 4.

Next, each configuration of the flush water supply device 6 of the flush toilet 1 according to the present embodiment will be schematically described with reference to FIG. 1. First, as shown in FIG. 1, the flush water supply device 6 includes, from an upstream side to a downstream side of the main water passageway 2, a stop cock 24, a splitter hardware 26, a valve unit 28, and the switching valve 18. Next, the valve unit 28 includes a water supply pipe elbow 28*a*, a constant flow valve 30, a diaphragm main valve 32, and an electromagnetic valve 34 such as a solenoid valve. Furthermore, the flush water supply device 6 includes a controller 36. The controller 36 is capable of functioning as a controller that controls an opening-closing operation of an on-off valve (the electromagnetic valve 34) of the valve unit 28, a switching operation of the switching valve 18, and a rotational speed, an operation time, and the like of the pressure pump 22.

Moreover, the constant flow valve 30 of the valve unit 28 is for reducing flush water passing from the stop cock 24 on the main water passageway 2 and through the splitter hardware 26 to or below a predetermined flow rate. Additionally, for example, in a mode where the flush toilet 1 is provided with a private part washing device (not shown), a water supply pipe (not shown) for supplying flush water to the private part washing device (not shown) may also be connected to the splitter hardware 26. In addition, when the private part washing device (not shown) is omitted, the splitter hardware 26 may be omitted. Furthermore, at the valve unit 28, when an opening operation is performed on the electromagnetic valve 34 by the controller 36, the main valve 32 is opened, and flush water passing from the constant flow valve 30 and through the main valve 32 is supplied to the switching valve 18 at the branch part B on the downstream side of the main water passageway 2. The switching valve 18 is capable of supplying flush water from the main water passageway 2 to the rim-side water supply channel 2*a* and a tank-side water supply channel 2*c* at a same timing, and a ratio between water supplied to the rim side and water supplied to the tank side may be freely changed.

Next, the flush water supply device 6 includes a tank device T that enables flush water supplied from the main water passageway 2 to be supplied to the toilet main body 4. The tank device T includes the storage tank 20 that is coupled to a rear side of the toilet main body 4 and that is for storing flush water supplied from the main water passageway 2, and the pump (the pressure pump 22) for feeding the flush water in the storage tank 20 to the toilet main body 4 under pressure. Furthermore, the rim-side water supply channel 2*a* that communicates with the rim conduit 14 of the toilet main body 4, and the tank-side water supply channel 2*c* that is connected to the storage tank 20 are provided on a downstream side of the branch part B on the downstream side of the main water passageway 2. Accordingly, flush water that is supplied from the main water supply source WO to the branch part B of the main water passageway 2 is used as water to be supplied to at least one of the rim-side water supply channel 2*a* to be supplied to the rim and the tank-side water supply channel 2*c* to be supplied to the tank.

Furthermore, the flush water supply device 6 includes a pump water supply channel 2*d* that extends from a downstream side of the tank-side water supply channel 2*c* to the pressure pump 22, and the jet-side water supply channel 2*b* that extends on a downstream side from the pressure pump 22. Accordingly, with the flush toilet 1 of the present embodiment, flush water that is supplied from the main water passageway 2 and that is directly under tap water pressure may be supplied from the rim-side water supply channel 2*a* of the flush water supply device 6 to the rim spout port 14*a*, via the rim conduit 14 of the toilet main body 4, and water may thus be spouted from the rim spout port 14*a* (so-called "rim spouting"). Furthermore, the flush water supplied from the main water passageway 2 to the flush water supply device 6 may flow through the tank-side water supply channel 2*c*, the storage tank 20, the pump water supply channel 2*d* and the pressure pump 22 of the flush water supply device 6 and then be supplied from the jet-side water supply channel 2*b* to the jet spout port 16*a*, via the jet conduit 16 of the toilet main body 4, and water may thus be spouted from the jet spout port 16*a* (so-called "jet spouting"). That is, the flush toilet 1 of the present embodiment may function as a so-called hybrid flush toilet 1 that is capable of using, in combination, rim spouting that uses flush water that is supplied from the main water passageway 2 and that is directly under tap water pressure, and jet spouting that uses flush water that is from the storage tank 20 and that is pressurized by the pressure pump 22.

Now, an upper float switch 38 and a lower float switch 40 are disposed inside the storage tank 20. A water level inside the storage tank 20 may be detected by these float switches 38, 40. For example, the upper float switch 38 is switched on when the water level inside the storage tank 20 reaches a predetermined water storage level, and the controller 36 detects an on state of the upper float switch 38 and causes the electromagnetic valve 34 to close. For its part, the lower float switch 40 is switched on when the water level inside the storage tank 20 falls to a predetermined water level below the predetermined water storage level that is detected by the upper float switch 38, and the controller 36 detects an on state of the lower float switch 40 and causes the pressure pump 22 to stop. Furthermore, the pressure pump 22 is for causing flush water stored in the storage tank 20 to be discharged from the jet spout port 16*a*, by suctioning the flush water into the pump water supply channel 2*d* and pressurizing the flush water in the pump water supply channel 2*d* into the jet-side water supply channel 2*b*.

With the structures described above, at a time of normal toilet flushing, the controller 36 detects an operation of a toilet flushing switch (not shown) by a user, for example, and causes the electromagnetic valve 34, the switching valve 18, and the pressure pump 22 to sequentially operate. Discharging of water from the rim spout port 14*a* and the jet spout port 16*a* is thus sequentially started, and flush water used to flush the bowl 8 is discharged from the water discharge trap 12, together with waste in the bowl 8. Furthermore, when flushing is over, the controller 36 opens the electromagnetic valve 34, and the switching valve 18 is switched to the tank-side water supply channel 2*c* side, and flush water in the main water passageway 2 is used to refill the storage tank 20. Then, when the water level inside the storage tank 20 rises and the upper float switch 38 detects a specified water storage amount, the controller 36 closes the electromagnetic valve 34, so that the main valve 32 closes the main water passageway 2, and supply of water is thereby stopped. Moreover, each unit of the flush water supply device 6 (control unit) is stored in a rear storage V0 (of which more later) in a region more rearward than the bowl 8 of the toilet main body 4.

Next, specific description will be given to the rear storage V0 where the flush water supply device 6 (control unit) is stored in the toilet main body 4 of the flush toilet 1 according to the present embodiment, and a peripheral structure of the rear storage V0 with reference to FIGS. 2 to 7. Here, the flush toilet 1 of the present embodiment shown in FIGS. 5 to 7 does not show the flush water supply device 6.

First, as shown in FIGS. 2 to 7, the toilet main body 4 includes a skirt 42 formed on an outer side than a side surface of each of the bowl 8 and the water discharge trap 12. Also, the rear storage V0 of the toilet main body 4 is provided below an upper end of the skirt 42 and on an inner side than the skirt 42 in the region more rearward than the bowl 8 of the toilet main body 4. The rear storage V0 includes an upper storage region V1 that is a storage region for storing at least a part of the flush water supply device 6 (control unit), a lower region V2 that is formed below and separated from the upper storage region V1, and a lower communication region V3 that is formed adjacent to and separated from the lower region V2 and that is formed below and communicates with the upper storage region V1. That is, the lower communication region V3 is separated from the lower region V2, and does not communicate with the lower region V2. On the other hand, the lower communication region V3 is a region that communicates between the upper storage region V1 and outside of the toilet main body 4.

Figure 4:
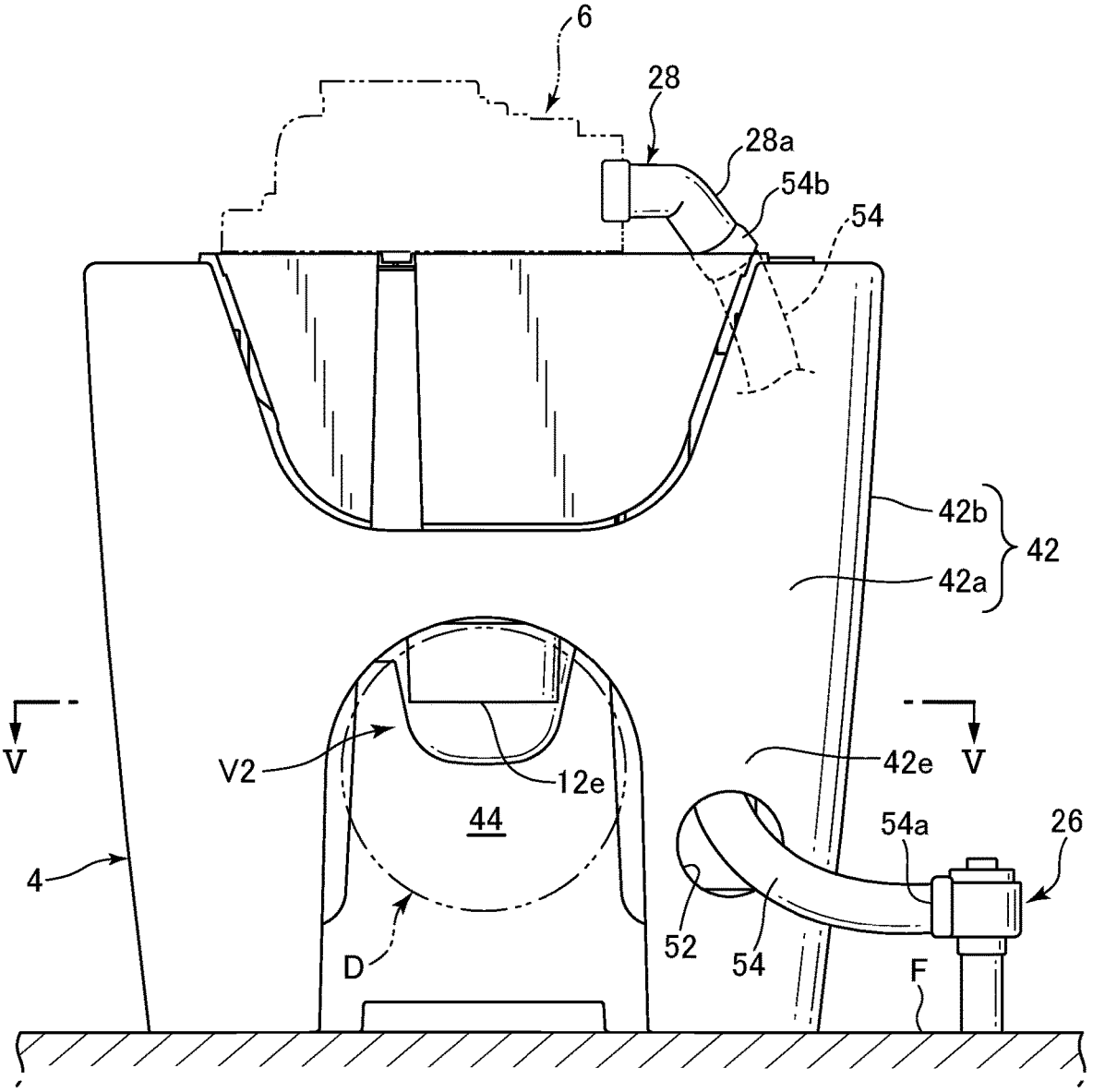
FIG. 4 is a back view of the flush toilet according to the first embodiment of the present invention.
Figure 5:
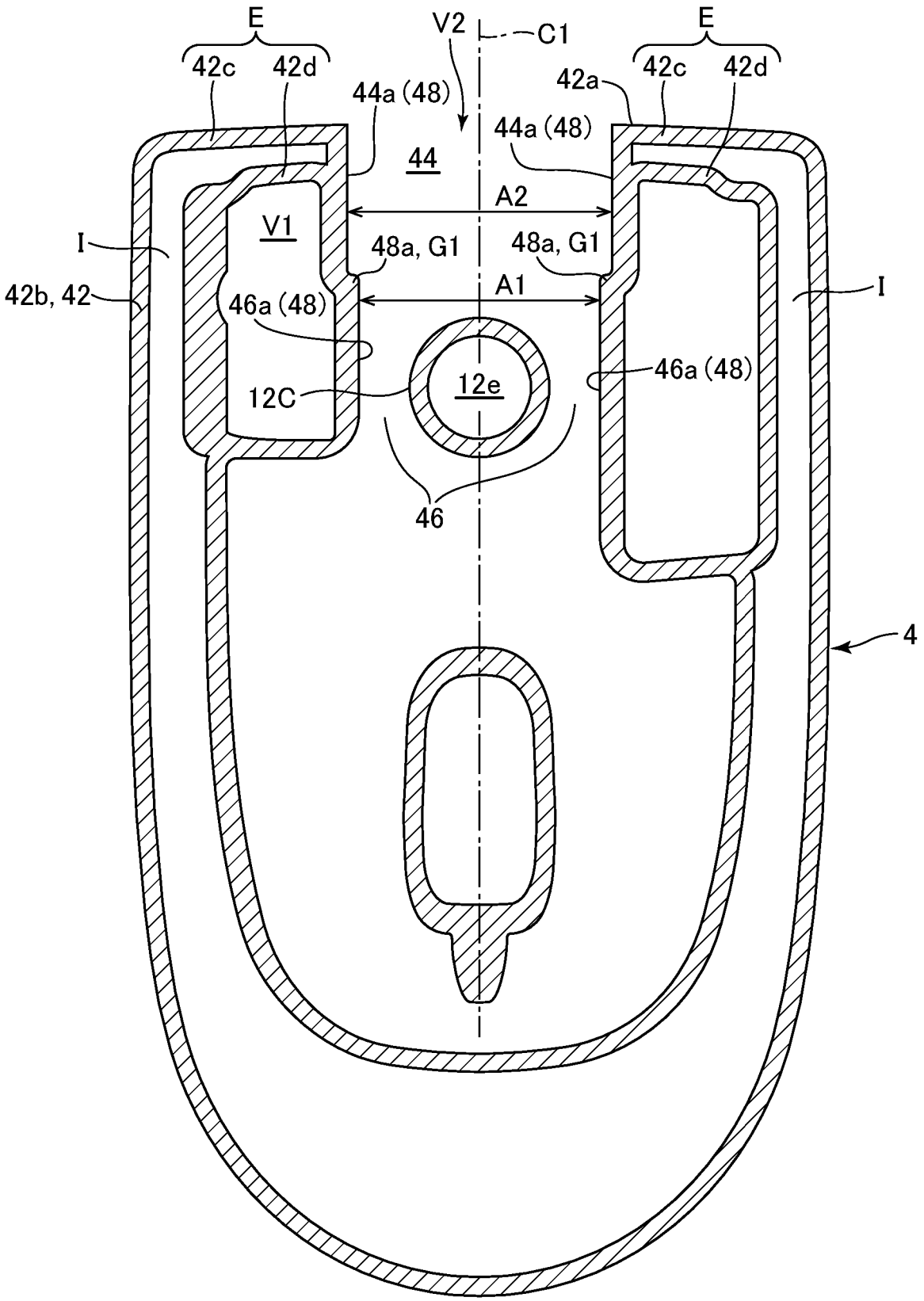
FIG. 5 is a cross-sectional view taken along a line V-V of FIG. 4.

Next, as shown in FIGS. 2 to 7, the skirt 42 includes a rear wall 42*a* provided on a back surface of the toilet main body 4, and a side wall 42*b* provided on each of left and right side surfaces of the toilet main body 4 seen from front. Also, a connection opening 44, to which the drainpipe D is connected, is formed penetrating, in a front-rear direction, a lower portion of the rear wall 42*a* of the skirt 42 at a center in a left-right direction as seen from front. Furthermore, as shown in FIG. 5, in the rear storage V0 of the toilet main body 4, a discharge socket storage 46 is formed in front of the connection opening 44 in the lower region V2. The discharge socket storage 46 functions as a storage region capable of storing the discharge socket S connected to the exit 12*e* of the descending pipe 12*c* of the water discharge trap 12. That is, the exit 12*e* of the descending pipe 12*c* of the water discharge trap 12 and the discharge socket S are arranged in the lower region V2 of the rear storage V0 of the toilet main body 4.

Figure 6:
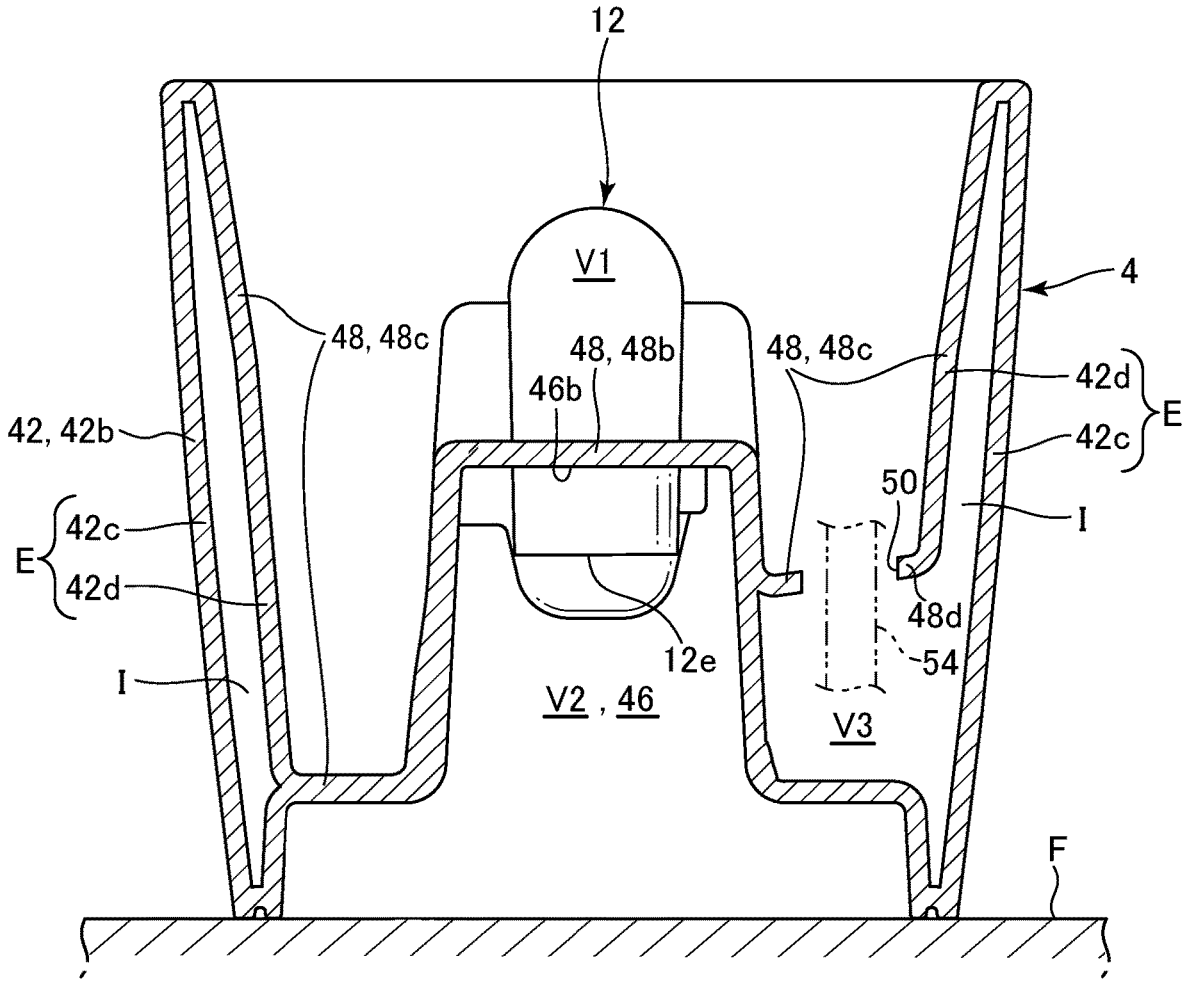
FIG. 6 is a cross-sectional view taken along a line VI-VI of FIG. 3.

Next, as shown in FIGS. 6 and 7, the rear storage V0 includes a supporting wall 48 that supports the flush water supply device 6 (control unit). The supporting wall 48 divides, in an up-down direction, a region more rearward than the bowl 8 of the toilet main body 4 into the upper storage region V1 and the lower region V2. Also, the upper storage region V1 of the rear storage V0 is a region capable of storing at least a part of the flush water supply device 6 (control unit). Furthermore, the lower region V2 of the rear storage V0 includes opening regions of the connection opening 44 and the discharge socket storage 46.

Next, as shown in FIGS. 5 and 6, the rear wall 42*a* and the side wall 42*b* of the skirt 42 form a double wall E including an outer wall 42*c* that forms an outer surface of the skirt 42, and an inner wall 42*d* provided inside the outer wall 42*c*. Also, the double wall E forms an internal space (double wall chamber I) between the outer wall 42*c* and the inner wall 42*d*.

Now, as shown in FIGS. 6 and 7, the supporting wall 48 of the rear storage V0 of the toilet main body 4 includes a main wall 48*b* that divides the region more rearward than the bowl 8 into the upper storage region V1 and the lower region V2. Also, the supporting wall 48 includes an auxiliary wall 48*c* provided outside the main wall 48*b* of the supporting wall. The auxiliary wall 48*c* includes the inner wall 42*d* of the skirt 42 that divides the region into the upper storage region V1 and the internal space (double wall chamber I) of the double wall E of the skirt 42. Furthermore, as shown in FIGS. 3, 6 and 7, the auxiliary wall 48*c* includes a bottom surface on one of left and right sides (the right bottom surface of the auxiliary wall 48*c* seen from rear in FIG. 6) including an inner communication hole 50 that communicates between the upper storage region V1 and the lower communication region V3 (the double wall chamber I of the double wall E of the skirt 42). Additionally, as shown in FIGS. 2, 4 and 7, in the rear wall 42*a* of the skirt 42, the outer wall 42*c* forms the double wall chamber I corresponding to the lower communication region V3, and includes an outer communication hole 52 that communicates between the lower communication region V3 and the outside of the toilet main body 4. The inner communication hole 50 and the outer communication hole 52 can communicate between the upper storage region V1 of the rear storage V0 and the outside of the toilet main body 4, through the lower communication region V3, not through the lower region V2 of the rear storage V0.

Now, as shown in FIGS. 6 and 7, the auxiliary wall 48*c* including the inner communication hole 50 includes a horizontal wall 48*d* that forms a substantially horizontal wall surface. Accordingly, the inner communication hole 50 is formed penetrating, in the up-down direction, the substantially horizontal wall surface of the horizontal wall 48*d*. Moreover, as shown in FIGS. 2, 4 and 7, the outer wall 42*c* of the lower communication region V3 (double wall chamber I), in which the outer communication hole 52 is formed, includes a vertical wall 42*e* that forms a vertical wall surface extending in the up-down direction. Accordingly, the outer communication hole 52 is formed penetrating, in the front-rear direction, the vertical wall surface of the vertical wall 42*e*. Furthermore, as shown in FIG. 7, the inner communication hole 50 has a center axis A1 positioned more rearward than a center A2 of the horizontal surface of the horizontal wall 48*d* in the front-rear direction, and the outer communication hole 52 is formed in the outer wall 42*c* of the double wall E in the rear wall 42*a* of the skirt 42.

Next, as shown in FIGS. 2 to 4, 6 and 7, the flush toilet 1 of the present embodiment includes a water supply hose 54 that is a flexible elongated member. The water supply hose 54 connects the splitter hardware 26 on a downstream side of the stop cock 24 and a part (the water supply pipe elbow 28*a*) of the valve unit 28 of the flush water supply device 6. Additionally, each of the inner communication hole 50 and the outer communication hole 52 described above also functions as a hole into which the water supply hose 54 can be inserted. Moreover, as shown in FIGS. 2 to 4, 6 and 7, the water supply hose 54 includes a lower connecting end portion 54*a* connected to the splitter hardware 26 disposed on a supply source side of flush water, and an upper connecting end portion 54*b* connected to the part (water supply pipe elbow 28*a*) of the valve unit 28 of the flush water supply device 6. That is, the water supply hose 54 extends from the upper connecting end portion 54*b* toward the lower connecting end portion 54*a*, and is accordingly inserted from the upper storage region V1 through the inner communication hole 50 into the lower communication region V3 (double wall chamber I). Afterward, the water supply hose 54 extends from the lower communication region V3 through the outer communication hole 52 to the outside of the toilet main body 4, not through the lower region V2, and then the lower connecting end portion 54*a* is connected to a supply source of flush water (the splitter hardware 26) in the vicinity of the floor F. Additionally, in the present embodiment, a mode is described where the water supply hose 54 on an upstream side (lower connecting end portion 54*a*) is connected to the splitter hardware 26.

However, when the splitter hardware 26 is omitted, for example, due to situations that the private part washing device (not shown) is omitted, the water supply hose 54 on the upstream side (lower connecting end portion 54*a*) may be connected directly to the stop cock 24.

Also, as shown in FIG. 7, more specially, the water supply hose 54 has the upper connecting end portion 54*b* connected to the water supply pipe elbow 28*a* extending diagonally forward and downward from a lateral side of the valve unit 28 of the flush water supply device 6. Then, the water supply hose 54 has the upper connecting end portion 54*b* once extending diagonally forward and downward or laterally and diagonally downward, and is then directed diagonally rearward and downward to the inner communication hole 50. Thereafter, the water supply hose 54 is inserted into the outer communication hole 52 through the inner communication hole 50 via the lower communication region V3 (double wall chamber I), not via the lower region V2, and the hose is guided to the outside of the toilet main body 4.

Next, description will be given to an operation of the flush toilet 1 according to the first embodiment of the present invention described above with reference to FIGS. 1 to 8. First, according to the flush toilet 1 of the first embodiment of the present invention, the water supply hose 54 that is the flexible elongated member extends, toward the lower connecting end portion 54*a*, from the upper connecting end portion 54*b* connected to the part (water supply pipe elbow 28*a*) of the valve unit 28 of the flush water supply device 6 in the upper storage region V1 of the rear storage V0. At this time, the water supply hose 54 can be inserted into the lower communication region V3 (double wall chamber I) through the inner communication hole 50 of the double wall E, without being bent or sharply angled from the upper storage region V1. Thereafter, the water supply hose 54 can smoothly extend from the lower communication region V3 (double wall chamber I) to the outside of the toilet main body 4 through the outer communication hole 52 of the double wall E, not through the lower region V2. Accordingly, for the water supply hose 54, most of a middle portion of a path of the hose can be hidden in the upper storage region V1 and the lower communication region V3 (double wall chamber I), so that designability such as appearance of the flush toilet 1 can improve. Furthermore, the flexible water supply hose 54 is inserted into the lower communication region V3 (double wall chamber I) from the upper storage region V1, without extending through the lower region V2, so that handleability of the water supply hose 54 in a limited space of the rear storage V0 of the toilet main body 4 can be improved while suppressing deformation load of the middle path of the water supply hose 54 between the part (water supply pipe elbow 28*a*) of the valve unit 28 of the flush water supply device 6 and the supply source of flush water (splitter hardware 26 or stop cock 24). Therefore, for example, permanent deformation or damage due to kink or the like can be inhibited from occurring in the flexible water supply hose 54. Additionally, from the viewpoint of fire prevention, for example, if a fire occurs on a back side of a rear wall of the toilet main body 4 or a peripheral part under the floor below the toilet main body 4 and even if the fire spreads from the wall back side or from under the floor to a combustible space in the lower region V2 of the rear storage V0 of the toilet main body 4, a downstream side of the exit 12*e* of the water discharge trap 12, or the like, each of the upper storage region V1 and the lower communication region V3 (double wall chamber I) of the rear storage V0 of the toilet main body 4 is separated from the lower region V2. Accordingly, risk of the fire in the lower region V2 spreading to the flush water supply device 6 in the upper storage region V1 and the water supply hose 54 in the lower communication region V3 (double wall chamber I) can be suppressed, and fire prevention for the flush water supply device 6 and the water supply hose 54 can be achieved. Furthermore, even if a foreign object from the outside of the toilet main body 4 enters the lower communication region V3 (double wall chamber I) through the outer communication hole 52, the lower communication region V3 (double wall chamber I) and the upper storage region V1 are divided at a portion other than the inner communication hole 50, and the foreign object from the outside of the toilet main body 4 can be inhibited from reaching the flush water supply device 6 of the upper storage region V1 through the outer communication hole 52.

Additionally, according to the flush toilet 1 of the present embodiment, the inner communication hole 50 of the inner wall 42*d*, penetrating to communicate between the upper storage region V1 and the lower communication region V3 (double wall chamber I), can be formed penetrating the substantially horizontal wall surface of the horizontal wall 48*d* of the inner wall 42*d* in the double wall E, and the outer communication hole 52 of the outer wall 42*c*, penetrating to communicate between the lower communication region V3 (double wall chamber I) and the outside of the toilet main body 4, can be formed penetrating the vertical wall surface of the vertical wall 42*e* of the outer wall 42*c* in the double wall E. Accordingly, when the water supply hose 54 is inserted from inside of the upper storage region V1 into the inner communication hole 50 and extended from inside of the lower communication region V3 (double wall chamber I) through the outer communication hole 52 to the outside of the toilet main body 4, the water supply hose 54 does not have to be bent excessively, and can be smoothly inserted. Therefore, for example, the permanent deformation or damage due to the kink or the like can be effectively inhibited from occurring in the flexible water supply hose 54.

Furthermore, according to the flush toilet 1 of the present embodiment, the inner communication hole 50 has the center axis A1 positioned more rearward than the center A2 of the horizontal wall 48*d* in the front-rear direction, and the outer communication hole 52 is formed in the outer wall 42*c* of the double wall E in the rear wall 42*a* of the skirt 42. Therefore, the inner communication hole 50 of the horizontal wall 48*d* can be disposed on a rear wall 42*a* side of the skirt 42, compared to when the center axis A1 of the inner communication hole 50 is positioned at the same position as or in front of the center A2 of the horizontal wall 48*d* in the front-rear direction. Consequently, a distance between the inner communication hole 50 and the outer communication hole 52 can be reduced, and hence when the water supply hose 54 is inserted into the inner communication hole 50 and the outer communication hole 52, the hose can be easily guided into the respective communication holes 50, 52. Thereby, it is not necessary to bend or sharply angle the flexible water supply hose 54. Also, since the center axis A1 of the inner communication hole 50 is positioned more rearward than the center A2 of the horizontal wall 48*d* in the front-rear direction, it is not necessary to excessively bend and deform the flexible water supply hose 54 so that the hose does not interfere with a front part or the like of the flush water supply device 6, when performing, for example, a work of connecting the upper connecting end portion 54*b* of the water supply hose 54 to the part (water supply pipe elbow 28*a*) of the valve unit 28 of the flush water supply device 6 in a state where the water supply hose 54 is inserted into the inner communication hole 50 and the outer communication hole 52. As a result, the permanent deformation or damage due to the kink or the like can be more effectively inhibited from occurring in the flexible water supply hose 54. Furthermore, by reducing the distance between the inner communication hole 50 and the outer communication hole 52, it is possible to suppress a thickness of the double wall E that forms the lower communication region V3 (double wall chamber I) between the inner communication hole 50 and the outer communication hole 52 into which the water supply hose 54 is inserted, so that the whole toilet main body 4 can be reduced in size.

According to the flush toilet 1 of the present embodiment, the water supply hose 54 can be smoothly handled by inserting the hose into the lower communication region V3 (double wall chamber I) formed below the upper storage region V1. Furthermore, it is possible to suppress a thickness of the side wall 42*b* of the skirt 42 and a width of the whole toilet main body 4 in a left-right horizontal direction, compared to when the hose is inserted into the double wall chamber I formed on a lateral side of the upper storage region V1. Therefore, the whole flush toilet 1 can be reduced (slimmed) in size.

According to the flush toilet 1 of the present embodiment, the water supply hose 54 has the upper connecting end portion 54*b* connected to a front or side portion of the flush water supply device 6, and the hose once extends diagonally forward and downward or laterally and diagonally downward, and is then directed diagonally rearward and downward to the inner communication hole. Therefore, the hose can be efficiently inserted into the outer communication hole 52 through the inner communication hole 50 via the lower communication region V3 (double wall chamber I), without extending through the lower region V2, and can be efficiently guided to the outside of the toilet main body 4. Furthermore, the flexible water supply hose 54 is inserted from the inside of the upper storage region V1 into the lower communication region V3 (double wall chamber I), without extending through the lower region V2, so that the handleability of the water supply hose 54 in the limited space of the rear storage V0 of the toilet main body 4 can be further improved while suppressing the deformation load of the middle path of the water supply hose 54 between the part (water supply pipe elbow 28*a*) of the valve unit 28 of the flush water supply device 6 and the supply source of flush water (splitter hardware 26 or stop cock 24). Therefore, for example, the permanent deformation or damage due to the kink or the like can be effectively inhibited from occurring in the flexible water supply hose 54.

Next, description will be given to a flush toilet 100 according to a second embodiment of the present invention with reference to FIG. 8. Here, in the flush toilet 100 according to the second embodiment of the present invention shown in FIG. 8, the same part as that of the flush toilet 1 according to the first embodiment of the present invention shown in FIG. 7 is denoted with the same reference sign, and this part is not described, and a different structural part will only be described. First, as shown in FIG. 8, the flush toilet 100 according to the second embodiment of the present invention includes a toilet main body 104 including a supporting wall 148 with an inner communication hole 150 formed therein, the supporting wall including an auxiliary wall 148*a*, the auxiliary wall including a vertical wall 148*b* that forms a vertical wall surface extending in an up-down direction. Accordingly, the inner communication hole 150 is formed penetrating the vertical wall surface of the vertical wall 148*b* in a front-rear direction. Also, as shown in FIG. 8, an outer communication hole 152 is formed in an outer wall 142*a* of a skirt 142 that forms a lower communication region V103 (double wall chamber I).

According to the flush toilet 100 of the second embodiment of the present invention described above, when a water supply hose 54 is inserted from inside of an upper storage region V101 into the inner communication hole 150, and extended from inside of the lower communication region V103 (double wall chamber I) through the outer communication hole 152 to outside of the toilet main body 104, the water supply hose 54 does not have to be excessively bent, and can be smoothly inserted. Also, a distance between the inner communication hole 150 and the outer communication hole 152 in the front-rear direction can be reduced, so that the whole toilet main body 104 can be reduced in size while acquiring the upper storage region V101. Furthermore, by reducing the distance between the inner communication hole 150 and the outer communication hole 152 in the front-rear direction, the water supply hose 54 can be easily guided into the respective communication holes 150, 152, when inserting the hose into the inner communication hole 150 and the outer communication hole 152. Therefore, the flexible water supply hose 54 does not have to be bent or sharply angled. Consequently, for example, permanent deformation or damage due to kink or the like can be effectively inhibited from occurring in the flexible water supply hose 54.

In the flush toilets 1, 100 according to the first and second embodiments of the present invention described above, an embodiment is described in which the water supply hose 54 is adopted as the flexible elongated member, but this embodiment is not restrictive, and the present invention is also applicable to another embodiment. For example, in another embodiment of the flexible elongated member, two water supply hoses may be used including a toilet flushing water supply hose 54 that supplies toilet flushing water to the flush water supply device 6, and a private part washing water supply hose that supplies private part washing water to the private part washing device (not shown), and these two water supply hoses may be inserted into inner communication holes 50, 150 and outer communication holes 52, 152, respectively. Alternatively, a further another embodiment of the flexible elongated member may be applied to a wiring hose into which a plurality of power supplying wires are inserted, to supply power to the flush water supply device 6, the private part washing device (not shown), a heater device (not shown) with cold district specifications and the like arranged in the toilet main body 4, 104, and this wiring hose may be inserted into each of the inner communication hole 50, 150 and the outer communication hole 52, 152.

Although the present disclosure has been explained with reference to specific, preferred embodiments, one of ordinary skill in the art will recognize that modifications and improvements can be made while remaining within the scope and spirit of the present disclosure. The scope of the present disclosure is determined solely by appended claims.

What is claimed is:

1. A flush toilet comprising:

a toilet main body made of ceramics, the toilet main body including a bowl configured to receive waste, a water discharge trap including an inlet connected to a lower portion of the bowl and an exit configured to discharge waste in the bowl, and a skirt formed on each outer side of the bowl and the water discharge trap;

a control unit provided more rearward than the bowl of the toilet main body, the control unit including at least a function of controlling discharge and stopping of flush water to the bowl;

a supply source provided below the control unit and outside the toilet main body, the supply source enabling water supply and/or power supply to the control unit, and a flexible elongated member configured to connect the supply source and the control unit; and wherein the toilet main body made of ceramics further includes a rear storage configured to store at least a part of the control unit, and the rear storage includes a supporting wall configured to support the control unit and configured to divide a region more rearward than the bowl of the toilet main body into upper and lower regions, and the supporting wall provides an upper storage region formed in the region above the supporting wall and configured to store at least a part of the control unit;

a lower region formed in the region below the supporting wall and separated from the upper storage region, the lower region including the exit of the water discharge trap; and a lower communication region formed adjacent to and separated from the lower region, the lower communication region being configured to communicate between the upper storage region and outside of the toilet main body without communicating with the lower region, and wherein the flexible elongated member includes an upper connecting end portion connected to the control unit, and a lower connecting end portion connected to the supply source, and the flexible elongated member extends from the upper connecting end portion toward the lower connecting end portion and is inserted from the upper storage region into the lower communication region, and then the flexible elongated member extends from inside of the lower communication region to the outside of the toilet main body without extending through the lower region, and then the lower connecting end portion is connected to the supply source.

2. The flush toilet according to claim 1, wherein the skirt includes a rear wall and a side wall which respectively form a back surface and a side surface of the skirt, at least a part of the side wall or the rear wall of the skirt forms a double wall, and the double wall includes an outer wall and an inner wall, the outer wall being forming an outer surface of the skirt and an inner wall being provided inside the outer wall, at least a part of the double wall being forming a double wall chamber in the lower communication region of the rear storage between the outer wall and the inner wall, the inner wall of the double wall forming the double wall chamber includes an inner communication hole formed to penetrate so as to communicate between the upper storage region and the double wall chamber, and the outer wall of the double wall forming the double wall chamber includes an outer communication hole formed to penetrate so as to communicate between the double wall chamber and the outside of the toilet main body, and the flexible elongated member extends from the upper connecting end portion of the upper storage region toward the lower connecting end portion and is inserted from the upper storage region into the double wall chamber through the inner communication hole in the double wall, and then the flexible elongated member extends from inside of the double wall chamber to the outside of the toilet main body through the outer communication hole of the double wall without extending through the lower region, and then the lower connecting end portion is connected to the supply source.

3. The flush toilet according to claim 2, wherein the inner wall in the double wall forming the double wall chamber includes a horizontal wall forming a substantially horizontal wall surface, the inner communication hole is formed to penetrate the substantially horizontal wall surface of the horizontal wall, the outer wall in the double wall forming the double wall chamber includes a vertical wall forming a vertical wall surface extending in an up-down direction, and the outer communication hole is formed to penetrate the vertical wall surface of the vertical wall.

4. The flush toilet according to claim 3, wherein the inner communication hole has a center axis positioned more rearward than a center of the horizontal wall in a front-rear direction, and the outer communication hole is formed in the outer wall of the double wall in the rear wall of the skirt.

5. The flush toilet according to claim 2, wherein the double wall chamber is formed below the upper storage region, and the elongated member is inserted from inside of the upper storage region through the inner communication hole into the double wall chamber.

6. The flush toilet according to claim 2, wherein the elongated member includes the upper connecting end portion connected to a front or side portion of the control unit, and the elongated member once extends diagonally forward and downward or laterally and diagonally downward, then the elongated member is directed diagonally rearward and downward to the inner communication hole, and after that the elongated member is inserted into the outer communication hole through the inner communication hole via the double wall chamber without extending through the lower region, and then the elongated member is guided to the outside of the toilet main body.

* * * * *